US009989281B2

(12) United States Patent
Kim et al.

(10) Patent No.: US 9,989,281 B2
(45) Date of Patent: Jun. 5, 2018

(54) AIR CONDITIONER AND METHOD FOR CONTROLLING THE SAME

(71) Applicant: LG ELECTRONICS INC., Seoul (KR)

(72) Inventors: Byeongsu Kim, Seoul (KR); Beomchan Kim, Seoul (KR); Younghwan Ko, Seoul (KR); Byoungjin Ryu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 471 days.

(21) Appl. No.: 14/247,579

(22) Filed: Apr. 8, 2014

(65) Prior Publication Data

US 2014/0305150 A1 Oct. 16, 2014

(30) Foreign Application Priority Data

Apr. 15, 2013 (KR) ..... 10-2013-0041154

(51) Int. Cl.
*F25B 13/00* (2006.01)
*F25B 30/02* (2006.01)
*F25B 41/04* (2006.01)

(52) U.S. Cl.
CPC ..... *F25B 13/00* (2013.01); *F25B 30/02* (2013.01); *F25B 41/04* (2013.01); *F25B 2313/005* (2013.01); *F25B 2313/02741* (2013.01); *F25B 2313/0314* (2013.01); *F25B 2313/0315* (2013.01); *F25B 2400/13* (2013.01);

(Continued)

(58) Field of Classification Search
CPC ..... F25B 41/04; F25B 2400/13; F25B 2313/02741; F25B 2600/2509; F25B 2313/0315; F25B 2700/21151; F25B 2313/0314
See application file for complete search history.

(56) References Cited

U.S. PATENT DOCUMENTS 6,694,750 B1 * 2/2004 Lifson ..... F25B 1/047 62/113
2007/0017249 A1 * 1/2007 Otsuka ..... F25B 1/047 62/513

(Continued)

FOREIGN PATENT DOCUMENTS

CN 102016447 A 4/2011
CN 102066855 A 5/2011

(Continued)

*Primary Examiner* — David Teitelbaum
*Assistant Examiner* — Nelson Nieves
(74) *Attorney, Agent, or Firm* — Dentons US LLP

(57) ABSTRACT

An air conditioner includes a compressor, an outdoor heat exchanger, an indoor heat exchanger, a converting unit, a first injection module, and a second injection module. The first injection module injects a portion of refrigerant flowing from the indoor heat exchanger to the outdoor heat exchanger to the compressor in a heating operation and supercools refrigerant flowing from the outdoor heat exchanger to the indoor heat exchanger in a cooling operation. The second injection module injects a portion of refrigerant flowing from the indoor heat exchanger to the outdoor heat exchanger to the compressor in the heating operation and injects refrigerant flowing from the outdoor heat exchanger to the indoor heat exchanger to the compressor in the cooling operation.

11 Claims, 10 Drawing Sheets

(52) U.S. Cl.
CPC ..... *F25B 2600/2509* (2013.01); *F25B 2700/21151* (2013.01); *F25B 2700/21152* (2013.01)

(56) References Cited

U.S. PATENT DOCUMENTS

| | | | | |
|---|---|---|---|---|
| 2007/0107451 | A1* | 5/2007 | Sakurai | F25B 31/008 62/228.3 |
| 2009/0044564 | A1* | 2/2009 | Okamoto | F25B 1/10 62/510 |
| 2009/0175748 | A1* | 7/2009 | Bush | F25B 1/10 418/5 |
| 2010/0095700 | A1* | 4/2010 | Bush | F25B 41/00 62/323.3 |
| 2010/0223939 | A1* | 9/2010 | Mitra | F25B 1/10 62/117 |
| 2010/0229582 | A1* | 9/2010 | Yamada | F25B 1/10 62/238.7 |
| 2011/0113804 | A1* | 5/2011 | Chin | F25B 1/04 62/222 |
| 2011/0113808 | A1* | 5/2011 | Ko | F25B 1/04 62/324.3 |
| 2011/0232325 | A1* | 9/2011 | Furui | F25B 13/00 62/510 |
| 2012/0103005 | A1* | 5/2012 | Kopko | F25B 1/047 62/430 |
| 2012/0125024 | A1* | 5/2012 | Ryu | F25B 40/02 62/115 |
| 2013/0081425 | A1* | 4/2013 | Jang | F04C 18/0292 62/498 |
| 2014/0026605 | A1* | 1/2014 | Ishimura | F25B 1/00 62/222 |
| 2015/0096321 | A1* | 4/2015 | Kawano | F25B 1/10 62/197 |
| 2015/0362235 | A1* | 12/2015 | Yamashita | F25B 1/10 62/196.1 |

FOREIGN PATENT DOCUMENTS

| | | | |
|---|---|---|---|
| CN | 102099639 | A | 6/2011 |
| CN | 103032321 | A | 4/2013 |
| EP | 2357427 | A1 | 8/2011 |
| EP | 2578885 | A1 | 4/2013 |
| EP | 2631563 | A1 | 8/2013 |
| JP | 2008138921 | | 6/2008 |
| WO | 2012098582 | A1 | 7/2012 |

* cited by examiner

AIR CONDITIONER AND METHOD FOR CONTROLLING THE SAME

This application claims priority to Korean Application No. 10-2013-0041154, filed on Apr. 15, 2013, which is incorporated by reference, as if fully set forth herein.

BACKGROUND

1. Field of the Disclosure

The present disclosure relates to an air conditioner and a method for controlling the air conditioner, and more particularly, to an air conditioner that can stably inject refrigerant to a compressor in both heating operation and cooling operation.

2. Description of the Related Art

Generally, an air conditioner is a system that keeps air cool and warm using a refrigeration cycle including an outdoor heat exchanger, an expansion valve, and an indoor heat exchanger. That is, the air conditioner may include a cooling device for keeping indoor air cool and a heating device for keeping indoor air warm. Alternatively, the air conditioner may be designed to have cooling and heating functions.

When the air conditioner is designed having the device with both the cooling and heating functions, the air conditioner includes a converting unit for converting a flow passage of refrigerant compressed by a compressor in accordance with an operational condition (i.e., an cooling operation and an heating operation). That is, in the cooling operation, refrigerant compressed by the compressor is directed to the outdoor heat exchanger through the converting unit. At this point, the outdoor heat exchanger functions as a condenser. Refrigerant condensed by the outdoor heat exchanger expands in an expansion valve and is introduced into the indoor heat exchanger. At this point, the indoor heat exchanger functions as a vaporizer. Refrigerant vaporized by the indoor heat exchanger is redirected into the compressor through the converting unit.

SUMMARY

The air conditioner improves its efficiency by injecting a portion of refrigerant condensed in the indoor heat exchanger into the compressor when the outdoor temperature excessively decreases upon heating operation. Even during cooling operation, this injection may be needed. Accordingly, an air conditioner with cooling and heating functions requires a structure in which the injection is possible during both heating operation and cooling operation.

Thus, one object is to provide an air conditioner that is designed to inject refrigerant to a compressor during both heating operation and cooling operation and a method for controlling the air conditioner.

The above object and other objects will be clearly understood by persons skilled in the art from the following description.

According to one aspect, there is provided an air conditioner including: a compressor to compress refrigerant, the compressor including a first inlet port, a second inlet port, a third inlet port, and an outlet port; an outdoor heat exchanger to allow refrigerant through the outdoor heat exchanger to heat-exchange with outdoor air; an indoor heat exchanger to allow refrigerant through the indoor heat exchanger to heat-exchange with indoor air; a converting unit to direct refrigerant discharged from the outlet port of the compressor to the outdoor heat exchanger in a cooling operation and to the indoor heat exchanger in the heating operation; a first injection module to inject a portion of the refrigerant flowing from the indoor heat exchanger to a second injection module to the third inlet port of the compressor in the heating operation and to supercool the refrigerant flowing from the second injection module to the indoor heat exchanger in the cooling operation; and the second injection module to inject a portion of the refrigerant flowing from the first injection module to the outdoor heat exchanger to the second inlet port of the compressor in the heating operation and to inject a portion of the refrigerant flowing from the outdoor heat exchanger to the first injection module to the second inlet of the compressor in the cooling operation.

According to another aspect, there is provided a method for controlling an air conditioner comprising a compressor including a first inlet port, a second inlet port, a third inlet port, and an outlet port, the method comprising: directing by a converting unit, refrigerant discharged from the outlet port of the compressor to an outdoor heat exchanger in a cooling operation and to an indoor heat exchanger in the heating operation; injecting by a first injection module, a portion of the refrigerant flowing from the indoor heat exchanger to the a second injection module, to the third inlet port of the compressor in the heating operation and to supercool the refrigerant, flowing from the second injection module to the indoor heat exchanger, in the cooling operation; and injecting by a second injection module a portion of the refrigerant flowing from thefirst injection module to the outdoor heat exchanger, to the second port of the compressor in the heating operation and a portion of the refrigerant, flowing from the outdoor heat exchanger to the first injection module, to the second inlet port of the compressor in the cooling operation.

The foregoing and other objects, features, aspects and advantages will become more apparent from the following detailed description of the embodiments when taken in conjunction with the accompanying drawings.

BRIEF DESCRIPTION OF THE DRAWINGS

The accompanying drawings, which are included to provide a further understanding of the disclosure and are incorporated in and constitute a part of this specification, illustrate embodiments of the invention and together with the description serve to explain the principles of the invention.

In the drawings.

DETAILED DESCRIPTION OF THE EMBODIMENTS

Figure 1:
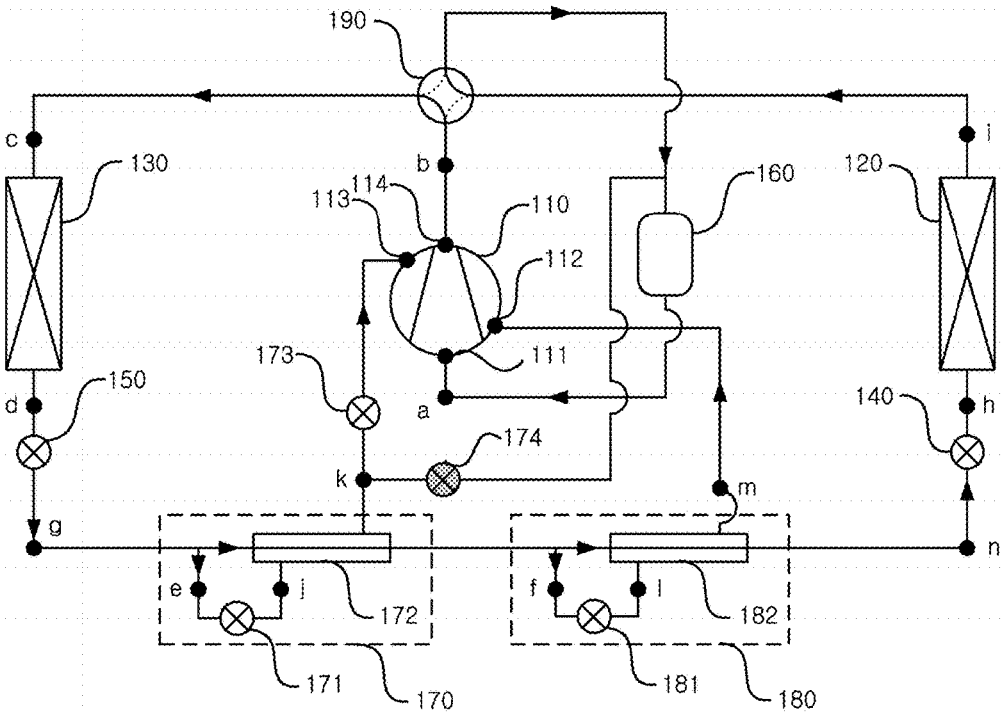
FIG. 1 is a block diagram illustrating a refrigerant flow in a heating operation of an air conditioner according to an exemplary embodiment of the present invention.

The foregoing and other objects, features, aspects and advantages will become more apparent from the following detailed description when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete to those skilled in the art. In the drawings, the shapes and dimensions may be exaggerated for clarity, and the same reference numerals will be used throughout to designate the same or like components.

Hereinafter, exemplary embodiments of the present invention will be described in detail with reference to the accompanying drawings.

FIG. 1 is a block diagram illustrating a refrigerant flow in a heating operation of an air conditioner according to an exemplary embodiment of the present invention.

An air conditioner of an exemplary embodiment of the present invention includes a compressor 110 for compressing refrigerant, an outdoor heat exchanger 120 that is installed out of a room for heat-exchange between outdoor air and refrigerant, an indoor heat exchanger 130 that is installed in the room for heat-exchange between indoor air and refrigerant, a converting unit 190 for directing refrigerant from the compressor 110 to the outdoor heat exchanger 120 in an cooling operation and directing refrigerant from the compressor 110 to the indoor heat exchanger 130 in a heating operation, a first injection module 170 for expanding a portion of refrigerant flowing from the outdoor heat exchanger 120 to the indoor heat exchanger 130 to inject the portion of refrigerant to the compressor 110 in the heating operation, and a second injection module 180 for expanding a portion of refrigerant flowing from the outdoor heat exchanger 120 to the indoor heat exchanger 130 to inject the portion of refrigerant to the compressor 110 in the heating operation.

The compressor 110 compresses refrigerant introduced from a low-pressure low-temperature state to a high-pressure high-temperature state. The compressor 110 may be formed in a variety of structures. That is, the compressor 110 may be a reciprocating compressor using a cylinder and a piston or a scroll compressor using an orbiting scroll and a fixed scroll. In this embodiment, the compressor 110 may be a scroll compressor. The compressor 110 may be provided in plurality according to embodiments.

The compressor 110 includes a first inlet port 111 through which refrigerant vaporized in the indoor heat exchanger 130 is introduced in the cooling operation or refrigerant vaporized in the outdoor heat exchanger 120 is introduced in the heating operation, a second inlet port 112 through which refrigerant with a relatively low pressure that is expanded and vaporized in the second injection module 180 is introduced, a third inlet port 113 through which refrigerant expanded and evaporated in the first injection module 170 is introduced, and an outlet port 114 through which the compressed refrigerant is discharged.

The second inlet port 112 is formed at a low pressure side of a compressing chamber of the compressor 110 in which refrigerant is compressed, and the third inlet port 113 is formed at a high pressure side of the compressing chamber of the compressor 110.

Refrigerant introduced through the first inlet port 111 has pressure and temperature that are lower than those of refrigerant introduced through the second inlet port 112, and refrigerant introduced through the second inlet port 112 has pressure and temperature that are lower than those of refrigerant introduced through the third inlet port 113. Refrigerant introduced into the third inlet port 113 has pressure and temperature that are lower than those of refrigerant discharged through the outlet port 114.

The compressor 110 compresses refrigerant introduced through the first inlet port 111 in the compressing chamber. Refrigerant introduced through the inlet port 111 and refrigerant introduced through the second inlet port 112 formed at a low pressure side of the compressing chamber are mixed with each other and compressed by the compressor 110. The compressor 110 compresses the mixed refrigerant together with refrigerant introduced through the third inlet port 113 formed at a high pressure side of the compressing chamber. The compressor 110 compresses the mixed refrigerant and then discharges the compressed refrigerant through the outlet port 114.

The accumulator 160 separates a gas-phase refrigerant and a liquid-phase refrigerant from refrigerant vaporized in the indoor heat exchanger 130 in the cooling operation or refrigerant vaporized in the outdoor heat exchanger 120 in the heating operation. The accumulator 160 is provided between the converting unit 190 and the first inlet port 111 of the compressor 110. The gas-phase refrigerant separated in the accumulator 160 is introduced into the compressor 110 through the first inlet port 111.

The converting unit 190 is a flow passage converting valve for cooling-heating conversion. The converting unit 190 directs refrigerant compressed in the compressor 110 to the outdoor heat exchanger 120 in the cooling operation and to the indoor heat exchanger 130 in the heating operation. In one embodiment, the converting unit 190 may be formed of a variety of valves or a combination thereof that can convert four flow passages.

The converting unit 190 is connected to the outlet port 114 of the compressor 110 and the accumulator 160 and is further connected to the indoor and outdoor heat exchangers 130 and 120. In the cooling operation, the converting unit 190 connects the outlet port 114 of the compressor 110 to the outdoor heat exchanger 120 and further connects the indoor heat exchanger 130 to the accumulator 160. In the heating operation, the converting unit 190 connects the outlet port 114 of the compressor 110 to the indoor heat exchanger 130 and further connects the outdoor heat exchanger 120 to the accumulator 160.

The converting unit 190 may be formed in a variety of different modules that can connect different passages to each other. In this exemplary embodiment, a four-way valve may be used for the converting unit 190. However, the present invention is not limited to this exemplary embodiment. A combination of two 3-way valves or other valves may be used as the converting unit.

The outdoor heat exchanger 120 may be disposed out of the room. Refrigerant heat-exchanges with the outdoor air while passing through the outdoor heat exchanger 120. The outdoor heat exchanger 120 functions as a condenser for condensing refrigerant in the cooling operation and as a vaporizer for vaporizing refrigerant in the heating operation.

The outdoor heat exchanger 120 is connected to the converting unit 190 and the outdoor expansion valve 140. In the cooling operation, refrigerant compressed in the compressor 110 and passing through the outlet port 114 of the compressor 110 and the converting unit 190 is introduced into the outdoor heat exchanger 120 and condensed, after which refrigerant is directed to the outdoor expansion valve 140. In the heating operation, refrigerant expanding in the outdoor expansion valve 140 is introduced into the indoor heat exchanger 120 and vaporized and discharged to the converting unit 190.

The outdoor expansion valve 140 is fully opened in the cooling operation to allow refrigerant to pass. In the heating operation, the opening degree of the indoor expansion valve 140 is adjusted to expand refrigerant. The outdoor expansion valve 140 is connected to the outdoor heat exchanger 120 and the second injection module 180. The outdoor expansion valve 140 is provided between the outdoor heat exchanger 120 and the second injection module 180.

The outdoor expansion valve 140 directs refrigerant introduced from the outdoor heat exchanger 120 to the second injection module 180 in the cooling operation. The outdoor expansion valve 140 expands refrigerant flowing from the second injection module 180 to the outdoor heat exchanger 120 in the heating operation.

The indoor heat exchanger 130 is disposed in the room to allow refrigerant passing through the indoor heat exchanger 130 to heat-exchange with the indoor air. In the cooling operation, the indoor heat exchanger 130 functions as a vaporizer for vaporizing refrigerant. In the heating operation, the indoor heat exchanger 130 functions as a condenser for condensing refrigerant.

The indoor heat exchanger 130 is connected to the converting unit 190 and the indoor expansion valve 150. In the cooling operation, refrigerant expanding in the indoor expansion valve 150 is directed into the indoor heat exchanger 130 and vaporized and discharged to the converting unit 190. In the heating operation, refrigerant that is compressed in the compressor 110 and passes through the outlet port 114 of the compressor 110 and the converting unit 190 is introduced into the heat exchanger 130 and condensed and directed to the indoor expansion valve 150.

In the cooling operation, the opening degree of the indoor expansion valve 150 is adjusted to expand refrigerant. In the heating operation, the indoor expansion valve 150 is fully opened to allow refrigerant to pass therethrough. The indoor expansion valve 150 is connected to the indoor heat exchanger 130 and the first injection module 170. The indoor expansion valve 150 is disposed between the indoor heat exchanger 130 and the first injection module 170.

In the cooling operation, the indoor expansion valve 150 expands refrigerant flowing from the first injection module 170 to the indoor heat exchanger 130. In the heating operation, the indoor expansion valve 150 directs refrigerant from the indoor heat exchanger 130 to the first injection module 170.

The first injection module 170 injects or supercools a portion of refrigerant flowing between the indoor heat exchanger 130 and the outdoor heat exchanger 120 into the compressor 110 according to the operation conditions.

In the heating operation, the first injection module 170 expands a portion of refrigerant flowing from the indoor heat exchanger 130 to the second injection module 180 and injects the expanded refrigerant into the high pressure side of the compressor 110. The first injection module 170 is connected to the indoor expansion valve 150, the injection valve 173, the supercooling valve 174, and the second injection module 180.

In the heating operation, the first injection module 170 directs a portion of refrigerant flowing from the indoor heat exchanger 130 to the third inlet port 113 and inject the portion of refrigerant into the high pressure side of the compressor 110, and directs the other portion of refrigerant flowing from the indoor heat exchanger 130 to the second injection module 180.

In the cooling operation, the first injection module 170 may expand and direct a portion of refrigerant flowing from the outdoor heat exchanger 120 through the second injection module 180 to the accumulator 160, and may supercool and direct a portion of refrigerant flowing from the outdoor heat exchanger 120 through the second injection module 180 to the indoor expansion valve 150.

In the cooling operation, the first injection module 170 may not operate and may pass refrigerant flowing from the second injection module 180 to direct refrigerant to the indoor expansion valve 150.

The first injection module 170 includes a first injection expansion valve 171 for expanding a portion of refrigerant passing therethrough and a first injection heat exchanger 172 that supercools the other portion of refrigerant passing therethrough by heat-exchanging with refrigerant expanding in the first injection expansion valve 171.

The first injection expansion valve 171 is connected to the indoor expansion valve 150 and the first injection heat exchanger 172. The first injection expansion valve 171 may expand refrigerant injected from the indoor heat exchanger 130 to the compressor 110 in the heating operation. The first injection expansion valve 171 may expand refrigerant flowing from the second injection heat exchanger 182 to the accumulator 160 in the cooling operation.

In the heating operation, the first injection expansion valve 171 expands a portion of refrigerant heat-exchanged in the indoor heat exchanger 130 and passing through the indoor expansion valve 150 and directs the same to the first injection heat exchanger 172. In the heating operation, the first injection expansion valve 171 may adjust its opening such that the pressure of refrigerant passing therethrough is the same as the high pressure side of the compressor 110 connected to the third inlet port 113.

In the cooling operation, the first injection expansion valve 171 may expand a portion of refrigerant that flows from the second injection module 180 and passes through the first injection heat exchanger 172, and may direct the expanding refrigerant to the first injection heat exchanger 172. In the cooling operation, the first injection expansion valve 171 may be closed, and the first injection module 170 may not operate.

The first injection heat exchanger 172 is connected to the indoor expansion valve 150, the first injection expansion valve 171, the second injection expansion valve 181, the second injection heat exchanger 182, the injection valve 173, and the supercooling valve 174.

In the heating operation, the first injection heat exchanger 172 allows refrigerant, which comes from the indoor heat exchanger 130, to heat-exchange with refrigerant expanding in the first injection expansion valve 171. In the cooling operation, the first injection heat exchanger 172 allows refrigerant, which comes from the second injection module 180, to heat-exchange with refrigerant expanding in the first injection expansion valve 171.

In the heating operation, the first injection heat exchanger 172 allows a portion of refrigerant heat-exchanged in the indoor heat exchanger 130 and passing through the indoor expansion valve 150 to heat-exchange with refrigerant expanding in the first injection expansion valve 171. In the heating operation, refrigerant supercooled in the first injection heat exchanger 172 is directed to the second injection module 180, and refrigerant superheated is injected into the third inlet port 113 of the compressor 110 via the injection valve 173.

In the cooling operation, the first injection heat exchanger 172 allows refrigerant flowing from the second injection module 180 to heat-exchange with refrigerant expanding in the first injection expansion valve 171. In the cooling operation, refrigerant supercooled in the first injection heat exchanger 172 is directed to the indoor expansion valve 150 and refrigerant superheated is directed to the accumulator 160 via the supercooling valve 174. In the cooling operation, refrigerant superheated in the first injection heat exchanger 172 is directed to the first inlet port 111 of the compressor 110 via the supercooling valve 174.

In the cooling operation, when the first injection expansion valve 171 is closed, the first injection heat exchanger 172 may pass refrigerant flowing from the second injection module 180 to direct refrigerant to the indoor expansion valve 150.

The injection valve 173 is disposed between the first injection heat exchanger 172 and the third inlet port 113 of the compressor 110. The injection valve 173 is opened in the heating operation, and is closed in the cooling operation. In the heating operation, the injection valve 173 directs direct refrigerant expanding in the first injection expansion valve 171 and vaporized in the first injection heat exchanger 172 to the third injection port 113 of the compressor 110.

The supercooling valve 174 is disposed between the first injection heat exchanger 172 and the accumulator 160. The supercooling valve 174 is closed in the heating operation, and is opened in the cooling operation. In the cooling operation, the supercooling valve 174 directs refrigerant expanding in the first injection expansion valve 171 and vaporized in the injection heat exchanger 172 to the accumulator 160. Refrigerant directed to the accumulator 160 is mixed with refrigerant heat-exchanging in the indoor heat exchanger 130.

In one exemplary embodiment, the supercooling valve 174 may be disposed between the first injection heat exchanger 172 and the first inlet port 111 of the compressor 110. In this case, the supercooling valve 174 directs refrigerant expanding in the first injection expansion valve 171 and vaporized in the injection heat exchanger 172 in the cooling operation to the compressor 110.

The second injection module 180 injects a portion of refrigerant flowing between the indoor heat exchanger 130 and the outdoor heat exchanger 120 into the compressor 110 according to the operation conditions.

In the heating operation, the second injection module 180 expands a portion of refrigerant flowing from the first injection module 170 to the outdoor heat exchanger 120 and injects the expanded refrigerant into the lower pressure side of the compressor 110. The second injection module 180 is connected to the first injection module 170, the second inlet port 112 of the compressor 110, and the outdoor expansion valve 140.

In the heating operation, the second injection module 180 directs a portion of refrigerant flowing from the first injection module 170 to the second inlet port 112 of the compressor 110 to inject the portion of refrigerant into the lower pressure side of the compressor 110, and directs the other portion of refrigerant flowing from the first injection module 170 to the outdoor expansion valve 140.

In the cooling operation, the second injection module 180 may direct a portion of refrigerant flowing from the outdoor heat exchanger 120 to the second inlet port 112 of the compressor 110 to inject the portion of refrigerant into the low pressure side of the compressor 110, and may direct the other portion of refrigerant flowing from the outdoor heat exchanger 120 to the first injection module 170.

In the cooling operation, the second injection module 180 may not operate and may pass refrigerant flowing from the outdoor heat exchanger 120 to direct refrigerant to the first injection module 170.

The second injection module 180 includes a second injection expansion valve 181 for expanding a portion of refrigerant passing therethrough and a second injection heat exchanger 182 that supercools the other portion of refrigerant passing therethrough by heat-exchanging with refrigerant expanding in the second injection expansion valve 181.

The second injection expansion valve 181 is connected to the first injection heat exchanger 172 and the second injection heat exchanger 182. The second injection expansion valve 181 may expand refrigerant injected from the indoor heat exchanger 130 to the compressor 110.

In the heating operation, the second injection expansion valve 181 expands a portion of refrigerant discharged and branched from the first injection heat exchanger 172, and directs the same to the second injection heat exchanger 182. In the heating operation, the second injection valve 181 may adjust its opening such that the pressure of refrigerant passing therethrough is the same as the low pressure side of the compressor 110 connected to the second inlet port 112.

In the heating operation, the second injection expansion valve 181 may expand a portion of refrigerant heat-exchanged in the outdoor heat exchanger 120 and passing through the outdoor expansion valve 140, and may direct the same to the second injection heat exchanger 182. In the cooling operation, the second injection expansion valve 181 may be closed, and the second injection module 180 may not operate.

The second injection heat exchanger 182 is connected to the first injection heat exchanger 172, the second injection expansion valve 181, the second inlet port 112 of the compressor 110, and the outdoor expansion valve 140. In the heating operation, the second injection heat exchanger 182 allows refrigerant, which comes from the first injection module 170, to heat-exchange with refrigerant expanding in the second injection expansion valve 181. In the cooling operation, the second injection heat exchanger 182 allows refrigerant, which comes from the outdoor heat exchanger 120, to heat-exchange with refrigerant expanding in the second injection expansion valve 181.

In the heating operation, the second injection heat exchanger 182 allows a portion of refrigerant discharged and branched from the first injection heat exchanger 172 to heat-exchange with refrigerant expanding in the second injection expansion valve 181. In the heating operation, refrigerant supercooled in the second injection heat exchanger 182 is directed to the outdoor expansion valve 140, and refrigerant superheated is injected into the second inlet port 112 of the compressor 110.

In the cooling operation, the second injection heat exchanger 182 allows refrigerant heat-exchanged in the outdoor heat exchanger 120 and passing through the outdoor expansion valve 140 to heat-exchange with refrigerant expanding in the second injection expansion valve 181. In the cooling operation, refrigerant supercooled in the second injection heat exchanger 182 may be directed to the first injection module 170, and refrigerant superheated may be injected into the second inlet port 112 of the compressor 110.

In the cooling operation, when the second injection expansion valve 181 is closed, the second injection heat exchanger 182 may pass refrigerant heat-exchanged in the outdoor heat exchanger 120 and flowing from outdoor expansion valve 140 to direct refrigerant to the first injection module 170.

The second injection module 180 described above may not be configured with the second injection expansion valve 181 and the second injection heat exchanger 182, but may be an accumulator that separates a gas-phase refrigerant and a liquid-phase refrigerant such that the gas-phase refrigerant is injected.

Hereinafter, a heating operation of an air conditioner according to an exemplary embodiment of the present invention will be described with reference to FIG. 1.

Refrigerant compressed in the compressor 110 is discharged through the outlet port 114 and directed to the converting unit 190. In the heating operation, the converting unit 190 connects the outlet port 114 of the compressor 110 and the indoor heat exchanger 130. Therefore, refrigerant directed to the converting unit 190 is transferred to the indoor heat exchanger 130.

Refrigerant directed from the converting unit 190 to the indoor heat exchanger 130 is condensed by heat-exchanging with the indoor air. Refrigerant condensed in the indoor heat exchanger 130 is transferred to the indoor expansion valve 150. In the heating operation, the indoor expansion valve 150 is completely opened and thus refrigerant is directed to the first injection module 170.

A portion of refrigerant flowing from the indoor expansion valve 150 is directed to the first injection expansion valve 171 and the other portion of refrigerant is directed to the first injection heat exchanger 172.

Refrigerant directed to the first injection expansion valve 171 expands and then is directed to the first injection heat exchanger 172. Refrigerant expanding in the first injection expansion valve 171 is transferred to the first injection heat exchanger 172 and vaporized by heat-exchanging with refrigerant flowing from the indoor expansion valve 150 to the first injection heat exchanger 172. Refrigerant vaporized in the first injection heat exchanger 172 is directed to the third inlet port 113 of the compressor 110 via the injection valve 173 opened in the heating operation. Refrigerant directed to the third inlet port 113 is injected to the high pressure side of the compressor 110 to be compressed and then is discharged through the outlet port 114.

A portion of refrigerant flowing from the indoor expansion valve 150 is supercooled by heat-exchanging with refrigerant that expands by the first injection expansion valve 171 in the first injection heat exchanger 172. Refrigerant supercooled in the first injection heat exchanger 172 flows to the second injection module 180.

A portion of refrigerant flowing from the first injection heat exchanger 172 is directed to the second injection expansion valve 181, and the other portion of refrigerant is directed to the second injection heat exchanger 182.

Refrigerant directed to the second injection expansion valve 181 expands and then is directed to the second injection heat exchanger 182. Refrigerant expanding in the second injection expansion valve 181 is directed to the second injection heat exchanger 182 and is vaporized by heat-exchanging with refrigerant flowing from the first injection heat exchanger 172 to the second injection heat exchanger 182. Refrigerant vaporized in the second injection heat exchanger 182 is directed to the second inlet port 112 of the compressor 110. Refrigerant directed to the second inlet port 112 is injected to the low pressure side of the compressor 110 to be compressed and then is discharged through the outlet port 114.

A portion of refrigerant flowing from the first injection heat exchanger 172 is supercooled by heat-exchanging with refrigerant that expands by the second injection expansion valve 181 in the second injection heat exchanger 182. Refrigerant supercooled in the second injection heat exchanger 182 is directed to the outdoor expansion valve 140.

Refrigerant directed to the outdoor expansion valve 140 is expanded and then directed to the outdoor heat exchanger 120. Refrigerant directed to the outdoor heat exchanger 120 is vaporized by heat-exchanging with the outdoor air. Refrigerant vaporized in the outdoor heat exchanger 120 flows to the converting unit 190.

Since the converting unit 190 connects the outdoor heat exchanger 120 to the accumulator 160 in the heating operation, refrigerant directed from the outdoor heat exchanger 120 to the converting unit 190 is directed to the accumulator 160. Refrigerant directed to the accumulator 160 is separated into a gas-phase refrigerant and a liquid-phase refrigerant. The gas-phase refrigerant separated in the accumulator 160 is introduced into the compressor 110 through the first inlet port 111. Refrigerant directed to the first inlet port 111 is compressed in the compressor 110, and then is discharged through the outlet port 114.

Figure 2:
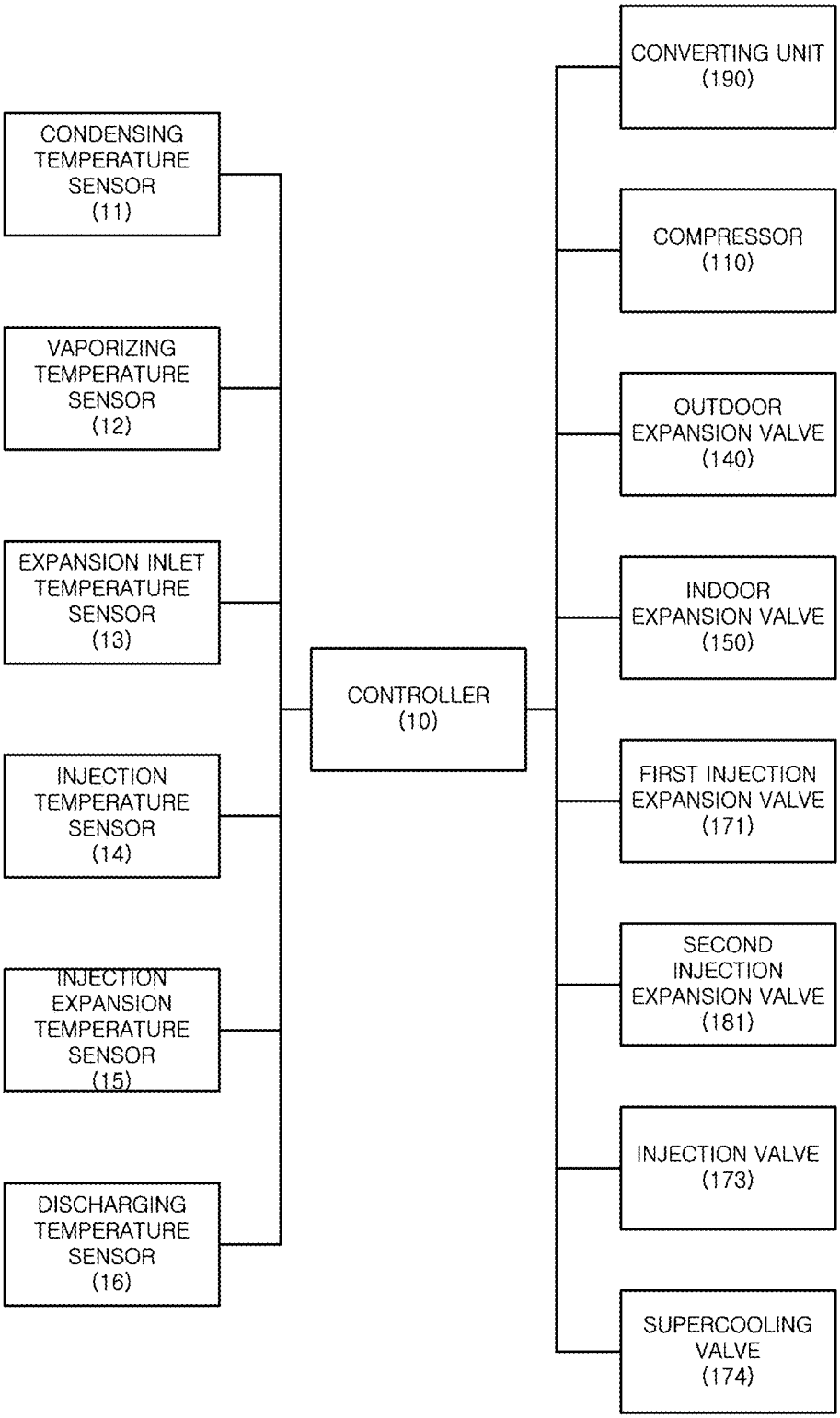
FIG. 2 is a block diagram of the air conditioner according to an exemplary embodiment of the present invention.

FIG. 2 is a block diagram of an air conditioner according to an exemplary embodiment of the present invention.

Referring to FIG. 2, an air conditioner according to an exemplary embodiment of the present invention includes a controller 10 for controlling the air conditioner, a condensing temperature sensor 11 for measuring a condensing temperature of refrigerant, and a vaporizing temperature sensor 12 for measuring a vaporizing temperature of refrigerant, an expansion inlet temperature sensor 13 for measuring an expansion inlet temperature before the expansion of refrigerant, an injection temperature sensor 14 for measuring an injection temperature of refrigerant injected from the second injection module 180 to the compressor 110, an injection expansion temperature sensor 15 for measuring a temperature of expanding refrigerant in the second injection expansion valve 181, and a discharging temperature sensor 16 for measuring a discharging temperature of refrigerant discharged from the compressor 110.

The controller 10 controls the operation of the air conditioner by controlling the converting unit 190, the compressor 110, the outdoor expansion valve 140, the indoor expansion valve 150, the first injection expansion valve 171, the second injection expansion valve 181, the injection valve 173, and the supercooling valve 174. The controller 10 selects the cooling and heating operations by controlling the converting unit 190. The controller 10 controls the operating speed of the compressor 110 according to a load. The controller 10 adjusts the opening degree of the outdoor expansion valve 140 in the heating operation and opens the outdoor expansion valve 140 in the cooling operation. The controller 10 opens the indoor expansion valve 150 in the heating operation and adjusts the opening degree of the indoor expansion valve 150 in the cooling operation. The controller 10 may adjust the opening degree of the first injection expansion valve 171 in the heating operation, and may adjust or close the opening degree of the first injection expansion valve 171 in the cooling operation. The controller 10 may adjust the opening degree of the second injection expansion valve 181 in the heating operation, and may adjust or close the opening degree of the second injection expansion valve 181 in the cooling operation. The controller 10 opens the injection valve 173 in the heating operation, and closes the injection valve 173 in the cooling operation. The controller 10 closes the supercooling valve 174 in the heating operation, and opens the supercooling valve 174 in the cooling operation.

The condensing temperature sensor 11 measures the condensing temperature of refrigerant in the indoor heat exchanger 130 in the heating operation, and measures the condensing temperature of refrigerant in the outdoor heat exchanger 120 in the cooling operation. In this exemplary embodiment, the condensing temperature sensor 11 is provided at a "d" location in the heating operation and at an "h" location in the cooling operation. In one embodiment, the condensing temperature sensor 11 may be provided on the indoor heat exchanger 130 in the heating operation, and may be provided on the outdoor heat exchanger 120 in the cooling operation.

In one embodiment, the condensing temperature of refrigerant may be calculated by measuring the pressure of refrigerant passing through the indoor heat exchanger 130 in the heating operation and may be calculated by measuring the pressure of refrigerant passing through the outdoor heat exchanger 120 in the cooling operation.

The vaporizing temperature sensor 12 measures the vaporizing temperature of refrigerant in the outdoor heat exchanger 120 in the heating operation, and measures the vaporizing temperature of refrigerant in the indoor heat exchanger 130 in the cooling operation. The vaporizing temperature sensor 12 may measure the vaporizing temperature by being located at a variety of locations. In this exemplary embodiment, the vaporizing temperature sensor 12 is provided at an "i" location in the heating operation and at a "c" location in the cooling operation. In one embodiment, the vaporizing temperature sensor 12 is provided on the outdoor heat exchanger in the heating operation and on the indoor heat exchanger in the cooling operation.

In one embodiment, the vaporizing temperature of refrigerant may be calculated by measuring the pressure of refrigerant passing through the outdoor heat exchanger 120 in the heating operation and calculated by measuring the pressure of refrigerant passing through the indoor heat exchanger 130 in the cooling operation.

The expansion inlet temperature sensor 13 measures the expansion inlet temperature of refrigerant ("n" location) introduced into the outdoor expansion valve 140 in the heating operation, and measure the expansion inlet temperature of refrigerant ("g" location) introduced into the indoor expansion valve 150 in the cooling operation. The expansion inlet temperature sensor 13 may measure the expansion inlet temperature of refrigerant by being located at a variety of locations. In this exemplary embodiment, the expansion inlet temperature sensor 13 is provided at an "n" location in the heating operation and at a "g" location in the cooling operation.

The injection temperature sensor 14 measures the injection temperature ("m" location) of refrigerant vaporized in the second injection heat exchanger 182 and injected to the low pressure side of the compressor 110 through the second inlet port 112. The injection temperature sensor 14 may be located at a variety of locations to measure the temperature of refrigerant injected to the lower pressure side of the compressor 110. In this exemplary embodiment, the injection temperature sensor 14 is provided at a "m" location.

The injection expansion temperature sensor 15 measures the injection expansion temperature ("l" location) of refrigerant expanding in the second injection expansion valve 181. The injection expansion temperature sensor 15 may be located at a variety of locations to measure the injection expansion temperature of refrigerant that is injected. In this exemplary embodiment, the injection expansion temperature sensor 15 is provided at a "l" location.

The discharging temperature sensor 16 measures the discharging temperature ("b" location) of refrigerant compressed in the compressor 110 and then discharged through the outlet port 114. The discharging temperature sensor 16 may be located at a variety of locations to measure the discharging temperature of refrigerant discharged from the compressor 110. In this exemplary embodiment, the discharging temperature sensor 16 is provided at a "b" location.

Figure 3:
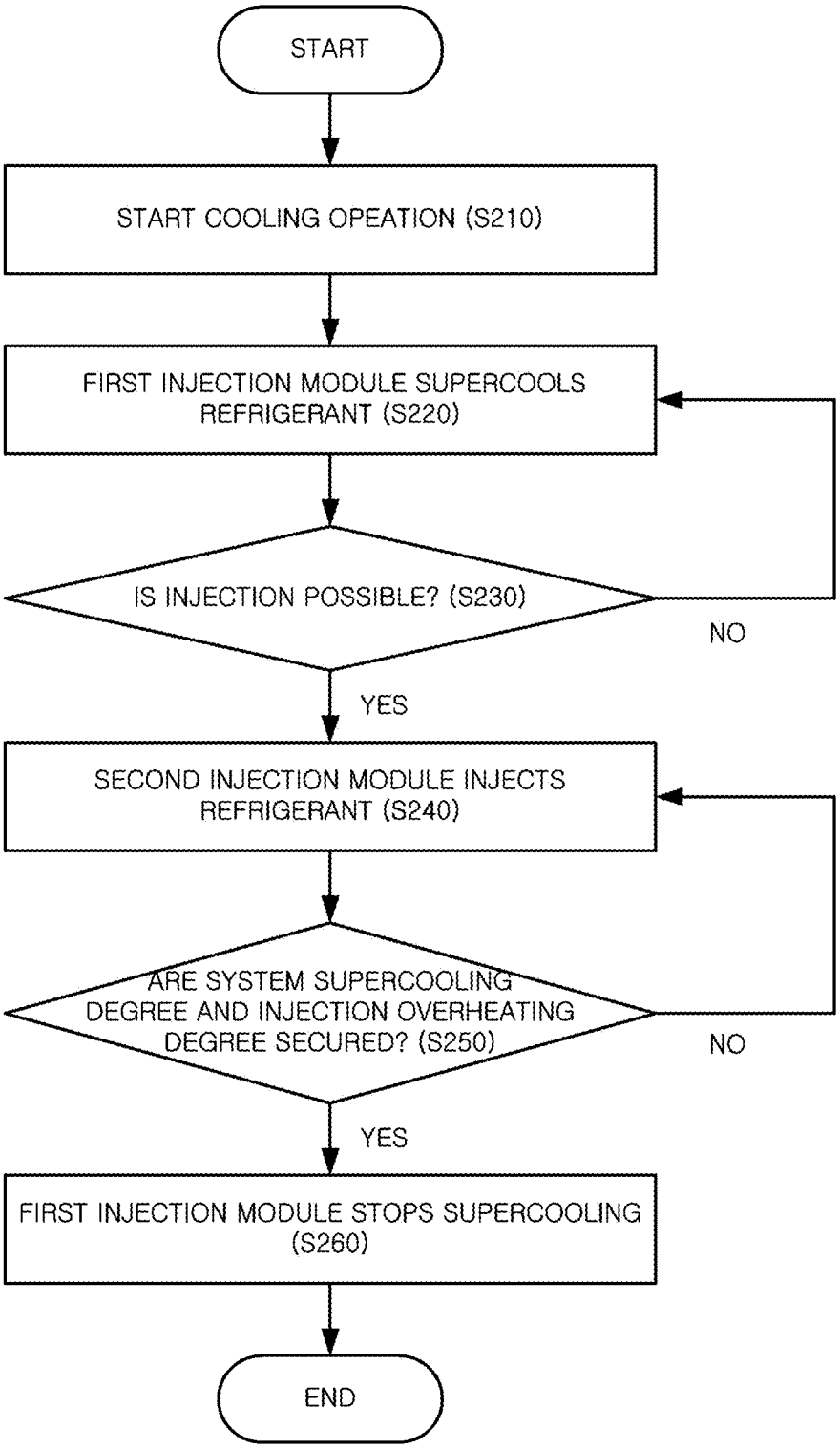
FIG. 3 is a flowchart of a method for controlling an air conditioner during a cooling operation according to an exemplary embodiment of the present invention.
Figure 4:
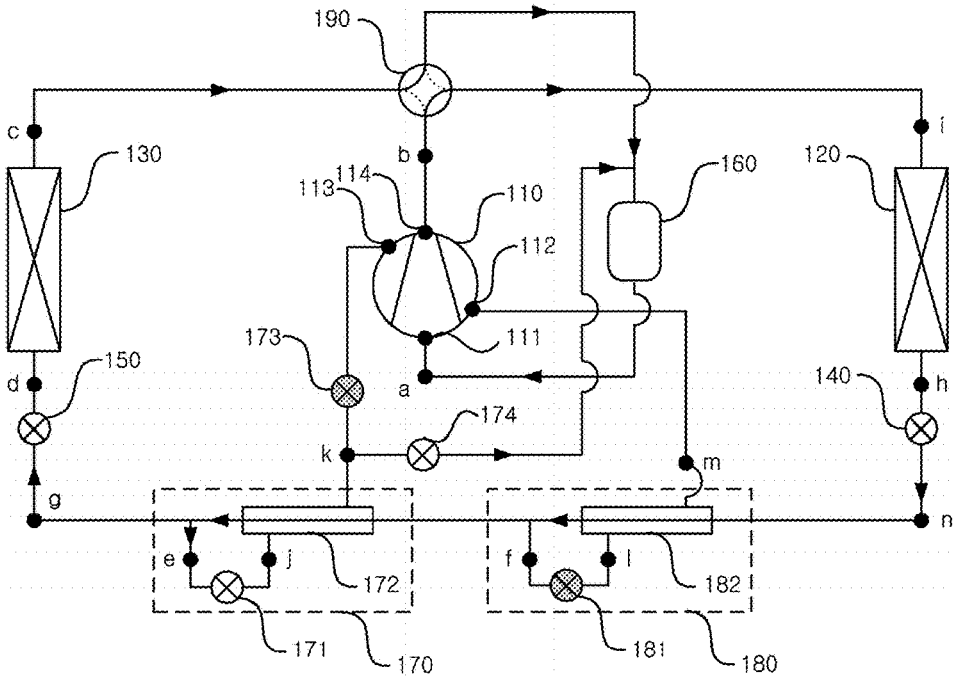
FIG. 4 is a block diagram illustrating an air conditioner when only supercooling is performed during a cooling operation according to an embodiment of the present invention.
Figure 5:
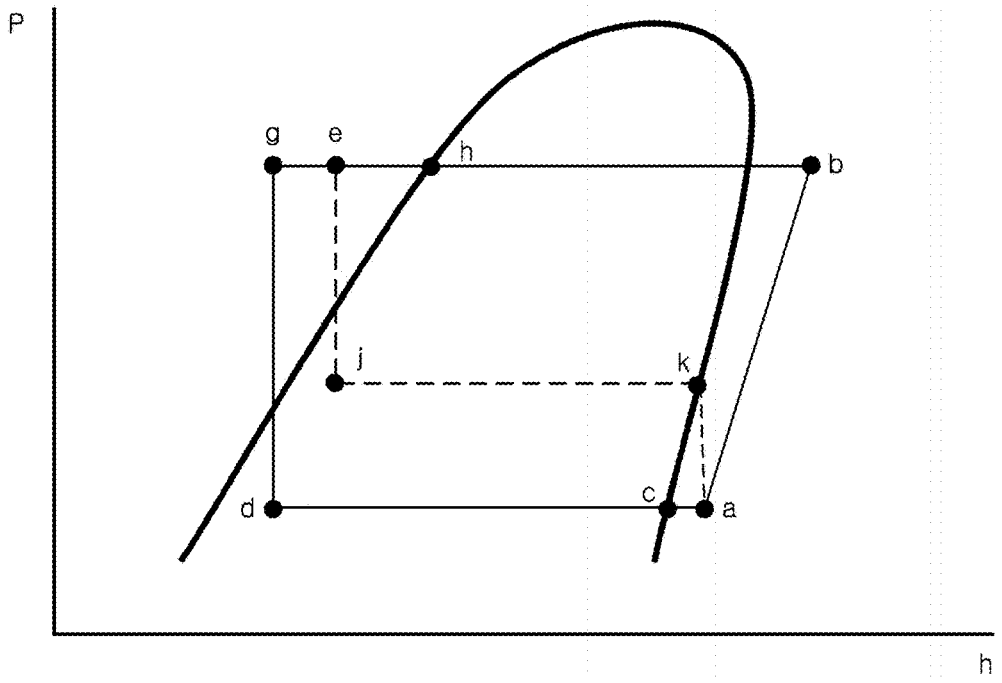
FIG. 5 is a pressure-enthalpy diagram (hereinafter, referred to as P-h diagram) of an air conditioner shown in FIG. 4.
Figure 6:
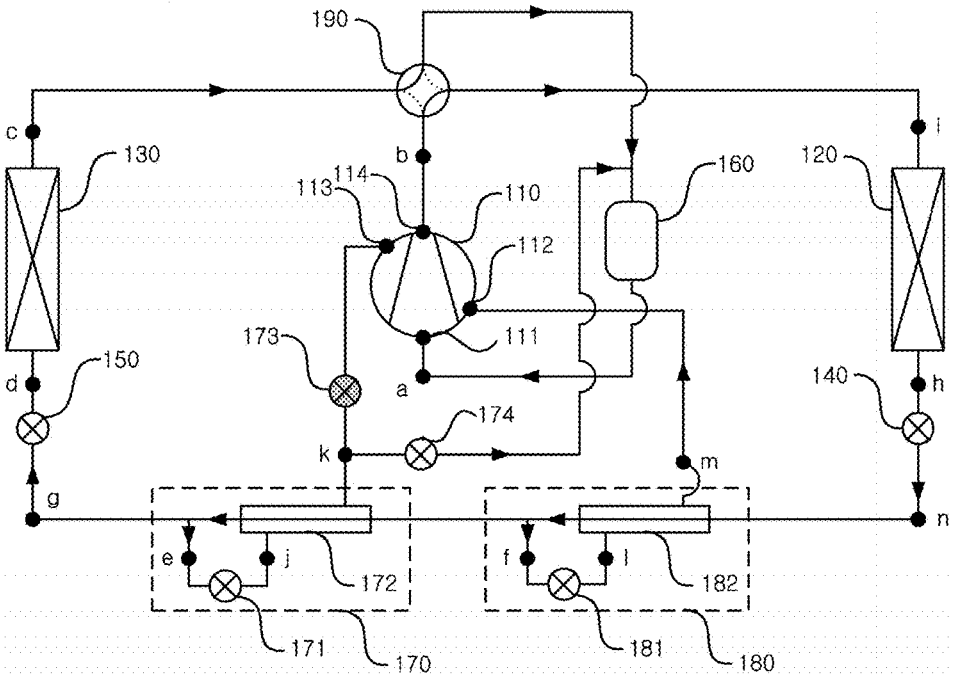
FIG. 6 is a block diagram illustrating an air conditioner when both supercooling and injection are performed according to an embodiment of the present invention.
Figure 7:
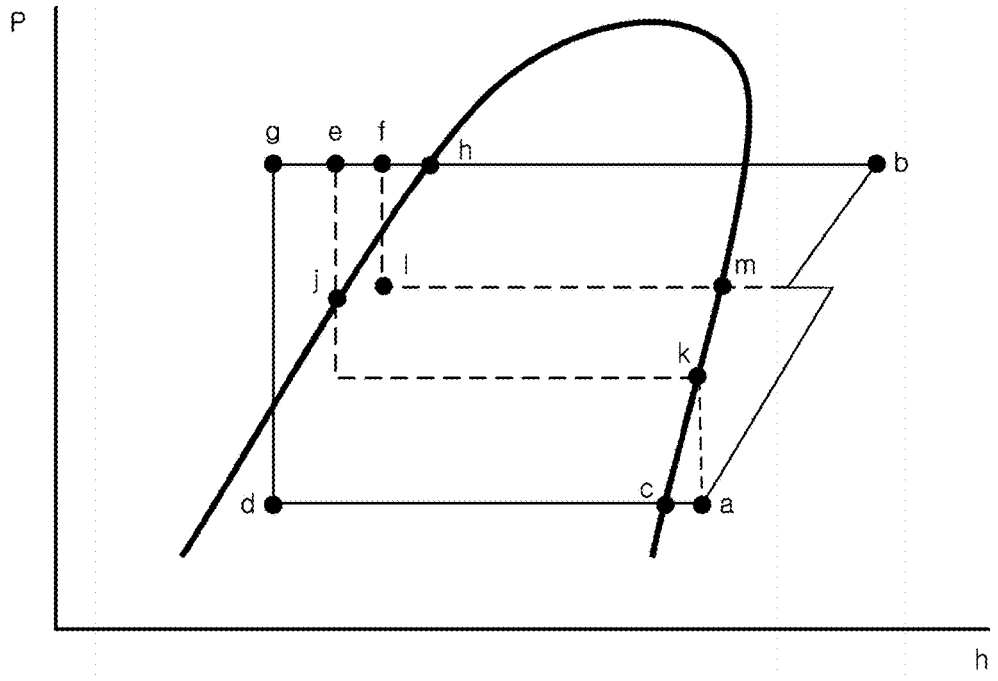
FIG. 7 is a P-h diagram of the air conditioner shown in FIG. 6.
Figure 8:
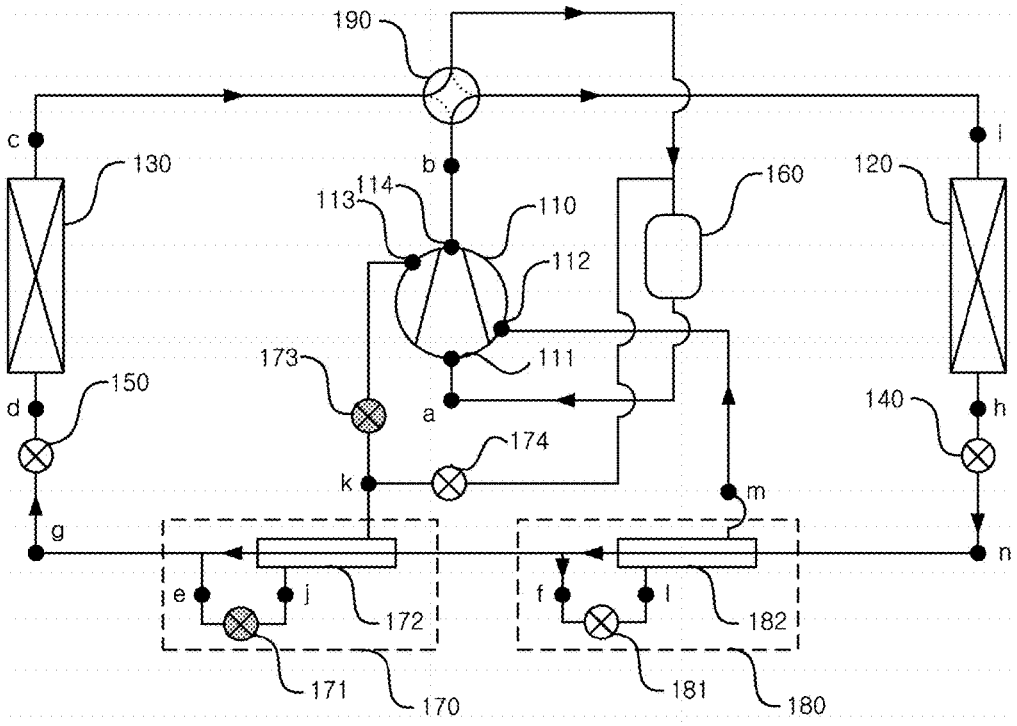
FIG. 8 is a block diagram illustrating an air conditioner when only injection is performed during a cooling operation according to an embodiment of the present invention.
Figure 9:
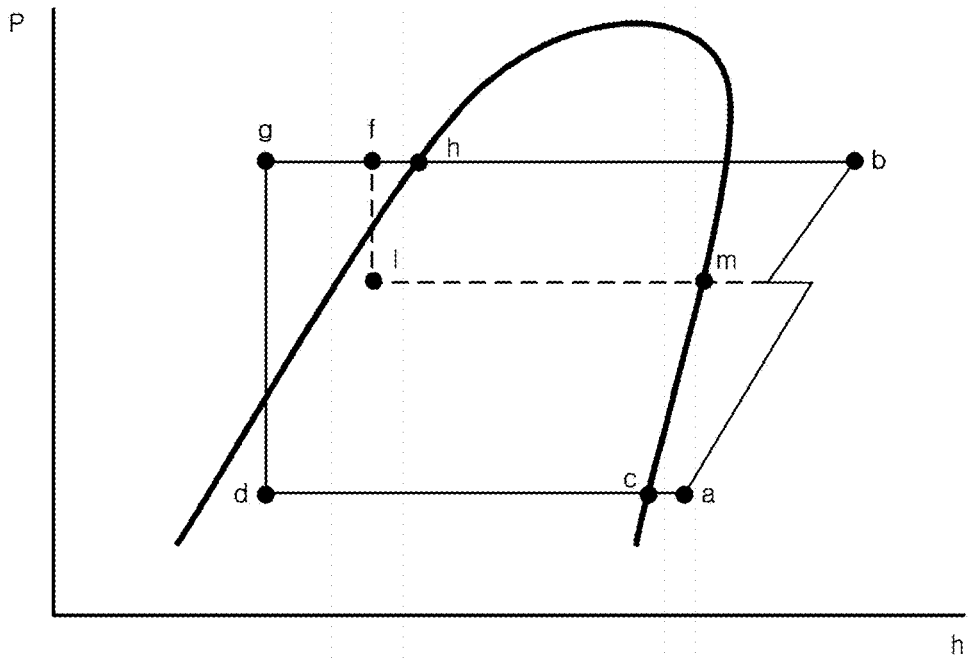
FIG. 9 is a P-h diagram of the air conditioner shown in FIG. 8.

FIG. 1 is a block diagram illustrating a refrigerant flow in a heating operation of an air conditioner according to an exemplary embodiment of the present invention. FIG. 2 is a block diagram of the air conditioner according to an exemplary embodiment of the present invention. FIG. 3 is a flowchart of a method for controlling an air conditioner during a cooling operation according to an exemplary embodiment of the present invention. FIG. 4 is a block diagram illustrating an air conditioner when only supercooling is performed during a cooling operation according to an embodiment of the present invention. FIG. 5 is a pressure-enthalpy diagram (hereinafter, referred to as P-h diagram) of an air conditioner shown in FIG. 4. FIG. 6 is a block diagram illustrating an air conditioner when both supercooling and injection are performed according to an embodiment of the present invention. FIG. 7 is a P-h diagram of the air conditioner shown in FIG. 6. FIG. 8 is a block diagram illustrating an air conditioner when only injection is performed during a cooling operation according to an embodiment of the present invention. FIG. 9 is a P-h diagram of the air conditioner shown in FIG. 8.

The controller 10 starts the cooling operation (S210). The controller 10 controls the converting unit 190 such that the outlet port 114 of the compressor 110 is connected to the outdoor heat exchanger 120 and the first inlet port of the compressor 110 is connected to the indoor heat exchanger 130. In accordance with the cooling operation control logic, the controller 10 completely opens the outdoor expansion valve 140, and controls the operating speed of the compressor 110 and the opening degree of the indoor expansion valve 150.

When the cooling operation starts, the first injection module 170 supercools refrigerant (S220). The second injection module 180 does not operate and passes refrigerant flowing from the outdoor heat exchanger 120 to direct refrigerant to the first injection module 170. The first injection module 170 supercools refrigerant flowing from the second injection module 180 to direct refrigerant to the indoor expansion valve 150.

The controller 10 adjusts the opening degree of the first injection expansion valve 171 such that the first injection module 170 supercools refrigerant, and closes the injection valve 173 and opens the supercooling valve 174. When the cooling operation starts, the controller 10 closes the second injection expansion valve 181 such that the second injection module 180 does not operate.

When the cooling operation starts, the system stability and the system supercooling degree need to be secured in order to enable injection through the second injection module 180. In the cooling operation, the system supercooling degree is a temperature difference between the saturation condensation temperature ("h" location) of the outdoor heat exchanger 120 measured by the condensing temperature sensor 11 and the expansion inlet temperature ("g" location) of the indoor expansion valve 150 measured by the expansion inlet temperature sensor 13. Accordingly, when the cooling operation starts, the controller 10 controls the first injection module 170 to supercool refrigerant and controls the second injection module 180 so as not to operate.

When the first injection module 170 supercools refrigerant and the second injection module 180 does not operate due to the start of the cooling operation, the operation of the air conditioner will be described below with reference to FIGS. 4 and 5.

Refrigerant compressed in the compressor 110 is discharged through the outlet port 114 and directed to the converting unit 190 via "b" location. In the cooling operation, the converting unit 190 connects the outlet port 114 of the compressor 110 to the outdoor heat exchanger 120 and thus refrigerant directed to the converting unit 190 is directed to the outdoor heat exchanger 120 via "i" location.

Refrigerant directed from the converting unit 190 to the outdoor heat exchanger 120 heat-exchanges with the outdoor air, and thus is condensed. Refrigerant condensed in the outdoor heat exchanger 120 is transferred to the outdoor expansion valve 140 via "h" location. In the cooling operation, the outdoor expansion valve 140 is completely opened and thus refrigerant passes through the outdoor expansion valve 140 and is then directed to the second injection module 180.

In the cooling operation, the second injection expansion valve 181 of the second injection module 180 is closed, and thus refrigerant directed to the second injection module 180 is directed to the first injection module 170 instead of passing through the second injection heat exchanger 182 to be directed to "f" location, "l" location, and "m" location.

Refrigerant transferred to the first injection module 170 is supercooled in the first injection heat exchanger 172. A portion of refrigerant supercooled in the first injection heat exchanger 172 is directed to the first injection expansion valve 171 via "e" location. Refrigerant expanding in the first injection expansion valve 171 heat-exchanges with refrigerant flowing from the second injection heat exchanger 182 at the first injection heat exchanger 172 via "j" location to be vaporized.

In the cooling operation, the injection valve 173 is closed and the supercooling valve 174 is opened. Therefore, refrigerant vaporized in the first injection heat exchanger 172 is transferred to the supercooling valve 174 via "k" location. Refrigerant passing through the supercooling valve 174 is directed to the accumulator 160, and then is mixed with refrigerant evaporated in the indoor heat exchanger 130.

A portion of refrigerant supercooled in the first injection heat exchanger 172 is directed to the indoor expansion valve 150 via "g" location. Refrigerant passing through "g" location is unchanged in pressure but is lowered in temperature compared to refrigerant passing through "h" location. That is, refrigerant passing through "g" location is supercooled, and thus the system supercooling degree can be secured.

Refrigerant expanding in the indoor expansion valve 150 is transferred to the indoor heat exchanger 130 via "d" location. Refrigerant directed to the indoor heat exchanger 130 is vaporized by heat-exchanging with the indoor air. Refrigerant vaporized in the indoor heat exchanger 130 is transferred to the converting unit 190 via "c" location.

Since the converting unit 190 connects the indoor heat exchanger 130 to the accumulator 160 in the cooling operation, refrigerant directed from the indoor heat exchanger 130 to the converting unit 190 is transferred to the accumulator 160. Refrigerant directed to the accumulator 160 is mixed with refrigerant direction from the supercooling valve 174 to be separated in to a gas-phase refrigerant and a liquid-phase refrigerant. The gas-phase refrigerant separated in the accumulator 160 is introduced into the compressor 110 through the first inlet port 111. Refrigerant directed to the first inlet port 111 is compressed in the compressor 110, and then is discharged through the outlet port 114.

When the first injection module 170 supercools refrigerant, the controller 10 determines whether or not the second injection module 180 can inject refrigerant into the compressor 110 (S230). The controller 10 determines whether or not the injection condition is satisfied. The injection condition may be set based on the operating speed of the compressor 110, the discharge superheating degree, the condensing temperature, or the vaporizing temperature.

The operating speed of the compressor 110 is an RPM of a motor (not shown) generating a torque for compressing refrigerant included in the compressor 110. The operating speed of the compressor 110 may be represented in a frequency unit. The operating speed of the compressor 110 is proportional to a compression capacity of the compressor 110. The controller 10 may determine whether or not the injection condition is satisfied by determining whether or not the operating speed of the compressor 110 is higher than a predetermined operating speed.

The discharge superheating degree is a difference between the discharging temperature measured by the discharging temperature sensor 16 and the condensing temperature measured by the condensing temperature sensor 11. That is, (discharge superheating degree)=(discharging temperature)−(condensing temperature). The controller 10 may determine whether or not the injection condition is satisfied by determining whether or not the discharge superheating degree is higher than a predetermined discharge superheating degree.

The condensing temperature is a condensing temperature of refrigerant measured by the condensing temperature sensor 11. In the cooling operation, the condensing temperature is a temperature at which refrigerant is condensed in the outdoor heat exchanger 120. The controller 10 may determine whether or not the injection condition is satisfied by determining whether or not the condensing temperature satisfies a predetermined condition. A detailed description thereof will be described in detail with reference to FIG. 10.

The vaporizing temperature is a vaporizing temperature of refrigerant measured by the vaporizing temperature sensor 12. In the cooling operation, the vaporizing temperature is a temperature at which refrigerant is vaporized in the indoor heat exchanger 130. The controller 10 may determine whether or not the injection condition is satisfied by determining whether or not the vaporizing temperature meets a predetermined condition. A detailed description thereof will be described in detail with reference to FIG. 10.

The condensing and vaporizing temperatures may have a condition having a linear function relationship. A detailed description thereof will be described in detail with reference to FIG. 10.

In one embodiment, the injection condition in the cooling operation may be set to meet one or at least two of the operating speed of the compressor 110, the discharge superheating degree, the condensing temperature, and the vaporizing temperature.

When the injection condition is satisfied, the second injection module 180 injects refrigerant to the compressor 110 (S240). The first injection module 170 supercools refrigerant, and the second injection module 180 operates to inject refrigerant to the low pressure side of the compressor 110. The controller 10 control the opening degree of the second injection expansion valve 181 such that the second injection module 180 operates.

When the first injection module 170 supercools refrigerant and the second injection module 180 injects refrigerant to the compressor 110 due to the satisfaction of the injection condition, the operation of the air conditioner will be described below with reference to FIGS. 6 and 7.

Refrigerant compressed in the compressor 110 is discharged through the outlet port 114 and directed to the converting unit 190 via "b" location. In the cooling operation, the converting unit 190 connects the outlet port 114 of the compressor 110 to the outdoor heat exchanger 120, and thus refrigerant directed to the converting unit 190 is directed to the outdoor heat exchanger 120 via "i" location.

Refrigerant directed from the converting unit 190 to the outdoor heat exchanger 120 heat-exchanges with the outdoor air, and thus is condensed. Refrigerant condensed in the outdoor heat exchanger 120 is transferred to the outdoor expansion valve 140 via "h" location. In the cooling operation, the outdoor expansion valve 140 is completely opened, and thus refrigerant passes through the outdoor expansion valve 140 and is then directed to the second injection module 180.

Since the second injection expansion valve 181 of the second injection module 180 is opened and the opening degree is adjusted upon satisfaction of the injection condition, refrigerant directed to the second injection module 180 is supercooled in the second injection heat exchanger 182. A portion of refrigerant supercooled in the second injection heat exchanger 182 is directed to the second injection expansion valve 181 via "f" location. Refrigerant expanding in the second injection expansion valve 181 heat-exchanges with refrigerant flowing from the outdoor heat exchanger 120 at the second injection heat exchanger 182 via "l" location to be vaporized.

Refrigerant vaporized in the second injection heat exchanger 182 is directed to the second inlet port 112 of the compressor 110 via "m" location. Refrigerant directed to the second inlet port 112 is injected to the low pressure side of the compressor 110 to be compressed and then is discharged through the outlet port 114.

Refrigerant supercooled in the second injection heat exchanger 182 flows to the first injection module 170.

Refrigerant transferred to the first injection module 170 is supercooled in the first injection heat exchanger 172. A portion of refrigerant supercooled in the first injection heat exchanger 172 is directed to the first injection expansion valve 171 via "e" location. Refrigerant expanding in the first injection expansion valve 171 heat-exchanges with refrigerant flowing from the second injection heat exchanger 182 at the first injection heat exchanger 172 via "j" location to be vaporized.

In the cooling operation, the injection valve 173 is closed and the supercooling valve 174 is opened. Therefore, refrigerant vaporized in the first injection heat exchanger 172 is transferred to the supercooling valve 174 via "k" location. Refrigerant passing through the supercooling valve 174 is directed to the accumulator 160, and then is mixed with refrigerant evaporated in the indoor heat exchanger 130.

A portion of refrigerant supercooled in the first injection heat exchanger 172 is directed to the indoor expansion valve 150 via "g" location. Refrigerant passing through "g" location is unchanged in pressure but is lowered in temperature compared to refrigerant passing through "h" location. That is, refrigerant passing through "g" location is supercooled, and thus the system supercooling degree can be secured.

Refrigerant expanding in the indoor expansion valve 150 is transferred to the indoor heat exchanger 130 via "d" location. Refrigerant directed to the indoor heat exchanger 130 is vaporized by heat-exchanging with the indoor air. Refrigerant vaporized in the indoor heat exchanger 130 is transferred to the converting unit 190 via "c" location.

Since the converting unit 190 connects the indoor heat exchanger 130 to the accumulator 160 in the cooling operation, refrigerant directed from the indoor heat exchanger 130 to the converting unit 190 is transferred to the accumulator 160. Refrigerant directed to the accumulator 160 is mixed with refrigerant direction from the supercooling valve 174 to be separated in to a gas-phase refrigerant and a liquid-phase refrigerant. The gas-phase refrigerant separated in the accumulator 160 is introduced into the compressor 110 through the first inlet port 111. Refrigerant directed to the first inlet port 111 is compressed in the compressor 110, and then is discharged through the outlet port 114.

When the first injection module 170 supercools refrigerant and the second injection module 180 injects refrigerant to the compressor 110, the controller 10 determines whether or not the system supercooling degree and the injection superheating degree are secured (S250). The controller 10 controls the opening degree of the first injection expansion valve 171 such that the system supercooling degree reaches a predetermined system supercooling degree, and controls the opening degree of the second injection expansion valve 181 such that the injection superheating degree reaches a predetermined injection superheating degree.

In the cooling operation, the system supercooling degree is a temperature difference between the saturation condensation temperature ("h" location) of the outdoor heat exchanger 120 measured by the condensing temperature sensor 11 and the expansion inlet temperature ("g" location) of the indoor expansion valve 150 measured by the expansion inlet temperature sensor 13. That is, (system superheating degree)=(saturation condensation temperature)−(expansion inlet temperature).

The injection superheating degree is a temperature difference between the injection temperature ("m" location) of refrigerant measured by the injection temperature sensor 14 and vaporized in the second injection heat exchanger 182 to be injected to the low pressure side of the compressor 110 via the second inlet port 112 and the injection expansion temperature ("l" location) of refrigerant measured by the injection expansion temperature sensor 15 and expanding in the second injection expansion valve 181. That is, (injection superheating degree)=(injection temperature)−(injection expansion temperature).

The controller 10 determines whether or not the system supercooling degree reaches a predetermined system supercooling degree, and determines whether or not the injection superheating degree reaches a predetermined injection superheating degree.

When the system supercooling degree and the injection superheating degree are secured, the first injection module 170 stops the supercooling (S260). When the injection superheating degree reaches a predetermined injection superheating degree and the system supercooling degree is equal to or greater than a predetermined system supercooling degree, the controller 10 stops the operation of the first injection module 170 and closes the first injection expansion valve 171 such that refrigerant is not supercooled.

After the first injection expansion valve 171 is closed, the controller 10 controls the opening degree of the second injection expansion valve 181 such that the injection superheating degree is maintained at a predetermined injection superheating degree. In one embodiment, when the system supercooling degree is reduced to a predetermined system supercooling degree or less, the controller 10 opens the first injection expansion valve 171 such that the first injection module 170 can supercool refrigerant.

When the supercooling of the first injection module 170 is stopped and the second injection module 180 injects refrigerant to the compressor 110 due to the securement of the system supercooling degree and the injection superheating degree, the operation of the air conditioner will be described below with reference to FIGS. 8 and 9.

Refrigerant compressed in the compressor 110 is discharged through the outlet port 114 and directed to the converting unit 190 via "b" location. In the cooling operation, the converting unit 190 connects the outlet port 114 of the compressor 110 to the outdoor heat exchanger 120, and thus refrigerant directed to the converting unit 190 is directed to the outdoor heat exchanger 120 via "i" location.

Refrigerant directed from the converting unit 190 to the outdoor heat exchanger 120 heat-exchanges with the outdoor air, and thus is condensed. Refrigerant condensed in the outdoor heat exchanger 120 is transferred to the outdoor expansion valve 140 via "h" location. In the cooling operation, the outdoor expansion valve 140 is completely opened, and thus refrigerant passes through the outdoor expansion valve 140 and is then directed to the second injection module 180.

Since the second injection expansion valve 181 of the second injection module 180 is opened and the opening degree is adjusted, refrigerant directed to the second injection module 180 is supercooled in the second injection heat exchanger 182. A portion of refrigerant supercooled in the second injection heat exchanger 182 is directed to the second injection expansion valve 181 via "f" location. Refrigerant expanding in the second injection expansion valve 181 heat-exchanges with refrigerant flowing from the outdoor heat exchanger 120 at the second injection heat exchanger 182 via "l" location to be vaporized.

Refrigerant vaporized in the second injection heat exchanger 182 is directed to the second inlet port 112 of the compressor 110 via "m" location. Refrigerant directed to the second inlet port 112 is injected to the low pressure side of the compressor 110 to be compressed and then is discharged through the outlet port 114.

Refrigerant supercooled in the second injection heat exchanger 182 flows to the first injection module 170.

When the system supercooling degree and the injection superheating degree are secured, the first injection expansion valve 171 of the first injection module 170 is closed, and thus refrigerant directed to the first injection module 170 is directed to the indoor expansion valve 150 instead of passing through the first injection heat exchanger 172 to be directed to "e" location, "j" location, and "k" location.

Refrigerant expanding in the indoor expansion valve 150 is transferred to the indoor heat exchanger 130 via "d" location. Refrigerant directed to the indoor heat exchanger 130 is vaporized by heat-exchanging with the indoor air. Refrigerant vaporized in the indoor heat exchanger 130 is transferred to the converting unit 190 via "c" location.

Since the converting unit 190 connects the indoor heat exchanger 130 to the accumulator 160 in the cooling operation, refrigerant directed from the indoor heat exchanger 130 to the converting unit 190 is transferred to the accumulator 160. Refrigerant directed to the accumulator 160 is separated into a gas-phase refrigerant and a liquid-phase refrigerant. The gas-phase refrigerant separated in the accumulator 160 is introduced into the compressor 110 through the first inlet port 111. Refrigerant directed to the first inlet port 111 is compressed in the compressor 110, and then is discharged through the outlet port 114.

In one embodiment, a second injection module (not shown) may be disposed between the second injection module 180 and the second inlet port 112 of the compressor 110. The second injection valve may be closed at an initial stage of the cooling operation (S210) such that the second injection module 180 does not operate. Also, the second injection valve may be opened at a satisfaction stage of the injection condition (S240) such that the second injection module 180 can inject refrigerant to the low pressure side of the compressor 110.

Figure 10:
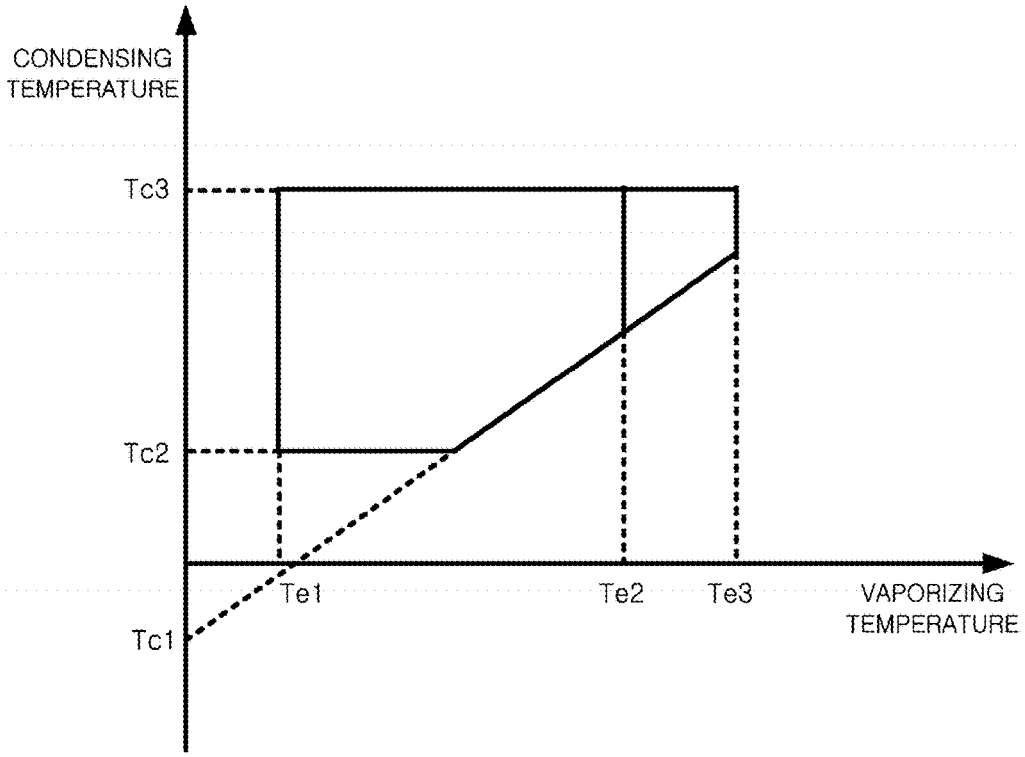
FIG. 10 is a diagram illustrating injection conditions for an air conditioner according to an exemplary embodiment of the present invention.

FIG. 10 is a diagram illustrating injection conditions for an air conditioner according to an exemplary embodiment of the present invention.

Hereinafter, the injection initiation condition in the heating operation and cooling operation, the injection condition in the heating operation, and the injection condition in the cooling operation will be described.

<Injection Initiation Condition>

In the heating operation and cooling operation, the operating speed of the compressor 110 needs to be greater than a predetermined operating speed and the discharge superheating degree needs to be greater than a predetermined discharge superheating degree to enable the injection to the compressor 110.

As described above, the operating speed of the compressor 110 is a rotation speed of a motor of the compressor 110, and the discharge superheating degree is a temperature difference between a discharging temperature measured by the discharging temperature sensor 16 and a condensing temperature measured by the condensing temperature sensor 11, which can be expressed as (discharge superheating degree)=(discharging temperature)−(condensing temperature).

The predetermined operating speed is a minimum operating speed at which a liquid refrigerant of the compressor 110 is not injected, and the operating speed of the compressor 110 needs to be greater than the minimum operating speed. In this exemplary embodiment, the predetermined minimum operating speed is about 30 Hz.

The predetermined discharge superheating degree is a minimum discharge superheating degree at which refrigerant introduced into the compressor is not superheated, and the discharge superheating degree that is a difference between the discharging temperature measured by the discharging temperature sensor 16 and the condensing temperature measured by the condensing temperature sensor 11 needs to be greater than the minimum discharge superheating degree. In this exemplary embodiment, the predetermined minimum discharge superheating degree is about 16 degrees Celsius.

Only when the above-mentioned two conditions are basically satisfied, in the heating operation, the first injection expansion valve 171 and the second injection expansion valve 181 are opened to initiate the injection, and in the cooling operation, the second injection expansion valve 181 is opened to initiate the injection.

<Heating Operation Injection Condition>

First, the compressor 110 needs to satisfy a minimum pressure ratio in which the injection can be performed. A condition that the vaporization pressure and the condensation pressure at the minimum pressure ratio of the compressor 110 are converted into temperature is as follows.

(Condensing Temperature)>$a$*(Vaporizing Temperature)+$Tc1$(here, $a$ is a positive number)

That is, the condensing temperature measured by the condensing temperature sensor 11 and the vaporizing temperature measured by the vaporizing temperature sensor 12 need to meet a linear inequality having a mutual linear function relationship.

In this case, the value a that is a slope is a straight-line slope obtained by converting the vaporization pressure and the condensation pressure at the minimum pressure ration at which the injection can be performed into temperature, and Tc1 is an intercept of the condensing temperature axis that considers the reliability.

Second, the condensing temperature needs to be lower than the maximum condensing temperature assured in the compressor 110. The maximum condensing temperature Tc3 in which the injection can be performed can be expressed as follows.

(Condensing Temperature)<$Tc3$($Tc3$>$Tc1$)

That is, the condensing temperature measured by the condensing temperature sensor 11 needs to be smaller than the predetermined maximum condensing temperature Tc3.

In this case, Tc3 is the maximum condensing temperature at which the compressor 110 is not damaged by burning, and needs to be greater than Tc1 that is the intercept of the condensing temperature axis of the first condition.

Third, the condensing temperature needs to be greater than the minimum condensing temperature at which the compressor 110 can operate. In the heating operation, the minimum condensing temperature Tc2 can be expressed as follows.

(Condensing Temperature)>$Tc2$($Tc1$<$Tc2$<$Tc3$)

That is, the condensing temperature measured by the condensing temperature sensor 11 needs to be greater than the predetermined minimum condensing temperature Tc2.

In this case, Tc2 is the maximum condensing temperature at which the oil discharging amount of the compressor 110 is not excessive, and needs to be greater than Tc1 that is the intercept of the condensing temperature axis of the first condition and smaller than the maximum condensing temperature of the second condition.

Fourth, the vaporizing temperature needs to be smaller than the maximum vaporizing temperature at which the compressor 110 can operate upon injection. The maximum vaporizing temperature Te2 can be expressed as follows.

(Vaporizing Temperature)<$Te3$

That is, the vaporizing temperature measured by the vaporizing temperature sensor 12 needs to be smaller than the predetermined maximum vaporizing temperature Te3.

In this case, Te3 is the maximum vaporizing temperature at which an overload does not occur in the compressor 110.

Fifth, the vaporizing temperature needs to be greater than the minimum vaporizing temperature at which the compressor 110 can operate in the heating operation. In the heating operation, the minimum vaporizing temperature Te1 can be expressed as follows.

(Vaporizing Temperature)>$Te1$

That is, the vaporizing temperature measured by the vaporizing temperature sensor 12 needs to be greater than the predetermined minimum vaporizing temperature Te1.

In this case, Tc3 is the minimum vaporizing temperature at which the oil viscosity limitation and burning damage of the compressor 110 do not occur, and needs to be smaller than Te3 that is the maximum vaporizing temperature of the fourth condition.

The above-mentioned injection conditions in the heating operation can be summarized as follows.

(Condensing Temperature)>$a$*(Vaporizing Temperature)+$Tc1$ (1)

(Condensing Temperature)<$Tc3$ (2)

(Condensing Temperature)>$Tc2$ (3)

(Vaporizing Temperature)<$Te3$ (4)

(Vaporizing Temperature)>$Te1$ (5)

Referring to FIG. 10, the above-mentioned heating operation conditions correspond to a certain region (heating operation injection region) on a two-dimensional plane in which the condensing temperature is the y-axis and the vaporizing temperature is the x-axis.

<Cooling Operation Injection Condition>

The cooling operation injection conditions are identical to the first, second, and fourth conditions of the heating operation injection conditions.

First, the compressor 110 needs to satisfy a minimum pressure ratio in which the injection can be performed.

(Condensing Temperature)>$a$*(Vaporizing Temperature)+$Tc1$

Second, the condensing temperature needs to be lower than the maximum condensing temperature Tc3 assured in the compressor 110.

(Condensing Temperature)<$Tc3$

Third, the vaporizing temperature needs to be smaller than the maximum vaporizing temperature Te3 at which the compressor 110 can operate upon injection.

(Vaporizing Temperature)<$Te3$

Since the above-mentioned injection conditions are identical to those of the heating operation injection conditions, a detailed description thereof will be omitted herein.

Fourth, the vaporizing temperature needs to be greater than the minimum vaporizing temperature at which the compressor 110 can operate in the cooling operation. In the cooling operation, the minimum vaporizing temperature Te2 can be expressed as follows.

(Vaporizing Temperature)>$Te2$($Te1$<$Te2$<$Te3$)

That is, the vaporizing temperature measured by the vaporizing temperature sensor 12 needs to be greater than the predetermined minimum vaporizing temperature Te2.

In this case, Te2 is the minimum vaporizing temperature at which the indoor heat exchanger 130 is not frozen, and needs to be smaller than Te3 that is the maximum vaporizing temperature of the third condition and greater than Te1 of the fifth condition of the heating operation injection conditions.

The reason why the third condition of the heating operation injection conditions is omitted from the cooling operation injection conditions is that this is naturally satisfied by the first condition and the fourth condition.

That is, since a*Te2+Tc1>Tc2, the condition regarding the minimum condensing temperature is not needed.

The above-mentioned injection conditions in the cooling operation can be summarized as follows.

$$(\text{Condensing Temperature}) > a*(\text{Vaporizing Temperature}) + Tc1 \quad (1)$$

$$(\text{Condensing Temperature}) < Tc3 \quad (2)$$

$$(\text{Vaporizing Temperature}) < Te3 \quad (3)$$

$$(\text{Vaporizing Temperature}) > Te2 \quad (4)$$

Referring to FIG. 10, the above-mentioned heating operation conditions correspond to a certain region (cooling operation injection region) on a two-dimensional plane in which the condensing temperature is the y-axis and the vaporizing temperature is the x-axis.

In this case, the cooling operation injection region falls within the cooling operation injection region. That is, the cooling operation injection conditions fall within the cooling operation injection conditions.

While this disclosure has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description but by the appended claims, and all differences within the scope will be construed as being included in the claims.

According to the air conditioner and the method for controlling the air conditioner of the present disclosure has at least one of the following effects.

First, refrigerant can be injected into the compressor in the cooling operation as well as in the heating operation.

Second, in the heating operation, refrigerant can be injected to the high pressure side and the low pressure side of the compressor, and in the cooling operation, refrigerant can be supercooled and injected to the low pressure side of the compressor.

Third, the injection can be performed by determining whether or not the injection can be performed in an appropriate condition.

Fourth, as the injection is performed by determining whether or not the injection can be performed after the supercooling is first performed in the cooling operation, the system efficiency can be improved.

Fifth, in the cooling operation, the system supercooling degree and the injection superheating degree are secured, and thus the system efficiency can be improved.

The effects according to the present disclosure are not limited to the above; other effects that are not described herein will be clearly understood by the persons skilled in the art from the following claims.

What is claimed is:

1. An air conditioner comprising:

a compressor to compress refrigerant, the compressor including a first inlet port, a second inlet port, a third inlet port, and an outlet port;

an outdoor heat exchanger to allow the refrigerant through the outdoor heat exchanger to heat-exchange with outdoor air;

an indoor heat exchanger to allow the refrigerant through the indoor heat exchanger to heat-exchange with indoor air a condensing temperature sensor configured to measure a condensing temperature of the refrigerant, and a vaporizing temperature sensor configured to measure a vaporizing temperature of the refrigerant;

a converting unit to direct the refrigerant discharged from the outlet port of the compressor to the outdoor heat exchanger in a cooling operation and to the indoor heat exchanger in a heating operation;

a first injection module to inject a portion of the refrigerant, flowing from the indoor heat exchanger to a second injection module, to the third inlet port of the compressor in the heating operation; and the second injection module to inject a portion of the refrigerant, flowing from the first injection module to the outdoor heat exchanger, to the second inlet port of the compressor in the heating operation;

an injection valve disposed between the first injection module and the compressor and configured to be opened to inject the portion of the refrigerant that is expanded in the first injection module to the third inlet port of the compressor in the heating operation;

an accumulator disposed between the converting unit and the compressor and for separating the refrigerant into a gas-phase refrigerant and a liquid-phase refrigerant; and a supercooling valve disposed between the first injection module and the accumulator and configured to be opened to direct the portion of the refrigerant that is expanded in the first injection module to the accumulator in the cooling operation;

a controller configured to:

control the converting unit to direct refrigerant discharged from the outlet port of the compressor to an outdoor heat exchanger to start the cooling operation;

control the first injection module to supercool the refrigerant flowing from the second injection module to the indoor heat exchanger, and open the supercooling valve to direct the portion of the refrigerant that is expanded in the first injection module to the accumulator, wherein the injection valve is closed, and control the second injection module not to operate and pass the refrigerant from the outdoor heat exchanger to the first injection module;

determines whether an injection condition is satisfied; and control the second injection module to inject the portion of the refrigerant to the second inlet port of the compressor, when the controller determines that the injection condition is satisfied, wherein the injection condition is that the condensing temperature at which refrigerant is condensed in the outdoor heat exchanger in the cooling operation and the vaporizing temperature at which refrigerant is vaporized in the indoor heat exchanger satisfy following conditions:

$$(\text{Condensing Temperature}) > a*(\text{Vaporizing Temperature}) + Tc1 \quad (1)$$

$$(\text{Condensing Temperature}) < Tc3 \quad (2)$$

$$(\text{Vaporizing Temperature}) < Te3 \quad (3)$$

$$(\text{Vaporizing Temperature}) > Te2, \quad (4)$$

whereby a: a predetermined positive constant, and

Tc1, Tc3, Te2, Te3: predetermined constants, Tc1<Tc3, Te2<Te3.

2. The air conditioner of claim 1, wherein the second inlet port is formed at a low pressure side of a compressing chamber of the compressor.

3. The air conditioner of claim 1, wherein the third inlet port is formed at a high pressure side of a compressing chamber of the compressor.

4. The air conditioner of claim 1, wherein in the cooling operation, the controller further:

determines whether a system supercooling degree reaches a predetermined system supercooling degree and an injection superheating degree reaches a predetermined injection superheating degree, wherein the system supercooling degree is a temperature difference between a saturation condensation temperature of the outdoor heat exchanger and an expansion inlet temperature of an indoor expansion valve, and the injection superheating degree is a temperature difference between an injection temperature of the refrigerant to be introduced through the second inlet port of the compressor and an injection expansion temperature of the refrigerant expanding in an second injection expansion valve of the second injection module.

5. The air conditioner of claim 1, wherein the first injection module comprises:

a first injection expansion valve to expand the portion of the refrigerant flowing to the first injection module; and a first injection heat exchanger to supercool an other portion of the refrigerant flowing through the first injection module by heat-exchanging with the portion of the refrigerant expanding in the first injection expansion valve, and the second injection module comprises:

a second injection expansion valve to expand the portion of flowing refrigerant flowing to the second injection module; and a second injection heat exchanger to supercool an other portion of the refrigerant flowing through the second injection module by heat-exchanging with the portion of the refrigerant expanding in the second injection expansion valve.

6. The air conditioner of claim 5, wherein in the cooling operation, when the injection condition is satisfied, the second injection expansion valve is opened.

7. The air conditioner of claim 6, when a system supercooling degree reaches a predetermined system supercooling degree and an injection superheating degree reaches a predetermined injection superheating degree, the first injection expansion valve is closed.

8. The air conditioner of claim 1, wherein the refrigerant introduced through the first inlet port has pressure and temperature lower than the refrigerant introduced through the second inlet port, the refrigerant introduced through the second inlet port has pressure and temperature lower than the refrigerant introduced through the third inlet port, and the refrigerant introduced through the third inlet port is lower than the refrigerant discharged through the outlet port.

9. A method for controlling an air conditioner comprising a compressor including a first inlet port, a second inlet port, a third inlet port, and an outlet port, the method comprising:

directing by a converting unit refrigerant discharged from the outlet port of the compressor to an outdoor heat exchanger to start cooling operation measuring, with a condensing temperature sensor, a condensing temperature of the refrigerant; measuring, with a vaporizing temperature sensor, a vaporizing temperature of the refrigerant;

supercooling by a first injection module the refrigerant, flowing from the second injection module to the indoor heat exchanger, and directing by a supercooling valve the portion of the refrigerant that is expanded in the first injection module to the accumulator, wherein an injection valve, disposed between the first injection module and the compressor, is closed, and a second injection module does not operate and passes the refrigerant from the outdoor heat exchanger to the first injection module; and injecting by the second injection module the portion of the refrigerant to the second inlet port of the compressor, when an injection condition is satisfied, wherein the injection condition is that the condensing temperature at which refrigerant is condensed in the outdoor heat exchanger in the cooling operation and the vaporizing temperature at which refrigerant is vaporized in the indoor heat exchanger satisfy following conditions:

$$(\text{Condensing Temperature}) > a*(\text{Vaporizing Temperature}) + Tc1 \quad (1)$$

$$(\text{Condensing Temperature}) < Tc3 \quad (2)$$

$$(\text{Vaporizing Temperature}) < Te3 \quad (3)$$

$$(\text{Vaporizing Temperature}) > Te2, \quad (4)$$

whereby a: a predetermined positive constant, and

Tc1, Tc3, Te2, Te3: predetermined constants, Tc1<Tc3, Te2<Te3.

10. The method of claim 9, wherein in the cooling operation, the method further comprising:

determining by the controller whether a system supercooling degree reaches a predetermined system supercooling degree and an injection superheating degree reaches a predetermined injection superheating degree, wherein the system supercooling degree is a temperature difference between a saturation condensation temperature of the outdoor heat exchanger and an expansion inlet temperature of an indoor expansion valve, and the injection superheating degree is a temperature difference between an injection temperature of the refrigerant to be introduced through the second inlet port of the compressor and an injection expansion temperature of the refrigerant expanding in an second injection expansion valve of the second injection module.

11. The method of claim 10, further comprising:

controlling by the controller the first injection module not to operate and pass the refrigerant through the first injection module and controlling the second injection module to continue injecting a portion of the refrigerant to the second inlet port of the compressor, when the controller determines that the system supercooling degree reaches the predetermined system supercooling degree and the injection superheating degree reaches the predetermined injection superheating degree.

* * * * *